US006997214B2

(12) United States Patent
Kuo

(10) Patent No.: US 6,997,214 B2
(45) Date of Patent: Feb. 14, 2006

(54) INTAKE TUBING FOR ENGINES

(76) Inventor: Lin Lin Kuo, No. 183, Sec. 3, Chonsan Road, Changhua (TW) 500

( * ) Notice: Subject to any disclaimer, the term of this patent is extended or adjusted under 35 U.S.C. 154(b) by 0 days.

(21) Appl. No.: 10/887,268

(22) Filed: Jul. 7, 2004

(65) Prior Publication Data

US 2006/0005892 A1 Jan. 12, 2006

(51) Int. Cl.
*F15D 1/02* (2006.01)
*B01F 5/06* (2006.01)

(52) U.S. Cl. ..... 138/39; 138/37; 138/109; 366/338; 366/339

(58) Field of Classification Search ..... 138/37, 138/39, 109; 366/338, 339
See application file for complete search history.

(56) References Cited

U.S. PATENT DOCUMENTS 1,301,245 A * 4/1919 Fox ..... 285/329
1,608,547 A * 11/1926 O'Fallon ..... 415/189
2,095,242 A * 10/1937 Dick ..... 239/400
3,117,821 A * 1/1964 Mylting ..... 406/191
3,719,207 A * 3/1973 Takeda ..... 366/181.5
3,955,835 A * 5/1976 Farrington ..... 285/148.19
4,492,192 A 1/1985 Baguelin ..... 123/198 F
4,555,129 A * 11/1985 Davlin ..... 285/3
4,703,785 A * 11/1987 Antos et al. ..... 141/326
4,813,715 A * 3/1989 Policelli ..... 285/222.2
6,112,768 A * 9/2000 Rath et al. ..... 138/39

* cited by examiner

*Primary Examiner*—Patrick Brinson
(74) *Attorney, Agent, or Firm*—Charles E. Baxley

(57) ABSTRACT

An intake tubing includes a tubular member having a number of helical protuberances and a number of helical grooves formed in an inner peripheral surface, an inlet end for receiving fluid, and an outlet end for coupling to an engine. The helical protuberances and the helical grooves of the tubular member may guide the fluid to flow through the tubular member in great speed and to increase power of the engine when the fluid flows quickly toward the inlet end of the tubular member, and to generate eddy current and to lower the flowing speed of the fluid when the fluid flows slowly toward the inlet end of the tubular member, in order to economize fuel or fluid.

3 Claims, 4 Drawing Sheets

INTAKE TUBING FOR ENGINES

BACKGROUND OF THE INVENTION

1. Field of the Invention

The present invention relates to an intake tubing for engines, and more particularly to an intake tubing for supplying gas and/or fuel into engines.

2. Description of the Prior Art

Typical engines comprise an injector coupled to a combustion chamber, for supplying gas and/or injecting fuel into the combustion chamber with intake tubing members, and for allowing the gas and/or the injecting fuel to be suitably combusted within the combustion chamber of the engines.

For example, U.S. Pat. No. 4,492,192 to Baguelin discloses one of the typical engines comprising an injection pump to send pressurized fuel oil and/or gas into the engine cylinder with manifolds or intake tubing members, to allow the pressurized fuel oil and/or the gas to be suitably combusted within the engine cylinder of the engines.

The manifolds or the intake tubing members for the typical engines normally comprises a smooth cylindrical inner surface formed or provided therein, for allowing the pressurized fuel oil and/or the gas to flow into or through the engine cylinders of the engines.

However, the pressurized fuel oil and/or the gas may only be supplied or flown through the manifolds or the intake tubing members in predetermined speeds, but may not flow into the manifolds or the intake tubing members in different speeds.

For example, when the engines are operated in high speed, it may required much more pressurized fuel oil and/or gas to flow into or through the engine cylinders of the engines via the manifolds or the intake tubing members. On the contrary, when the engines are operated in low speed, it may required less pressurized fuel oil and/or gas to flow into or through the engine cylinders of the engines via the manifolds or the intake tubing members.

However, the manifolds or the intake tubing members may not be used to adjust or to regulate the flowing speed and/or the flowing quantity of the pressurized fuel oil and/or the gas into or through the engine cylinders of the engines.

The present invention has arisen to mitigate and/or obviate the afore-described disadvantages of the conventional intake tubing members for engines.

SUMMARY OF THE INVENTION

The primary objective of the present invention is to provide an intake tubing for suitably adjusting or regulating the flowing speed and/or the flowing quantity of pressurized fuel oil and/or gas into or through the engine cylinders of the engines.

In accordance with one aspect of the invention, there is provided an intake tubing for an engine comprising a tubular member including a chamber formed therein and defined by an inner peripheral surface, and including a plurality of helical protuberances and a plurality of helical grooves formed therein, the tubular member including an inlet end for receiving fluid, and an outlet end for coupling to the engine. The helical protuberances and the helical grooves of the tubular member are provided to guide the fluid to flow through the chamber of the tubular member in great speed when the fluid is supplied in great speed toward the inlet end of the tubular member, and to generate eddy current and to lower the fluid to flow through the chamber of the tubular member when the fluid is supplied in low speed toward the inlet end of the tubular member.

The tubular member includes a flared member extended from the inlet end thereof, and the flared member includes an inner peripheral surface, and tapers conically from an outer opening with a greater diameter to an inner opening with a smaller diameter. The inner opening of the flared member includes an inner diameter greater than that of the inlet end of the tubular member, to form a peripheral shoulder between the tubular member and the flared member.

The tubular member includes a flared member extended from the outlet end thereof, and the flared member includes an inner peripheral surface, and tapers conically from an outer opening with a greater diameter to an inner opening with a smaller diameter. The inner opening of the flared member includes an inner diameter greater than that of the outlet end of the tubular member, to form a peripheral shoulder between the tubular member and the flared member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
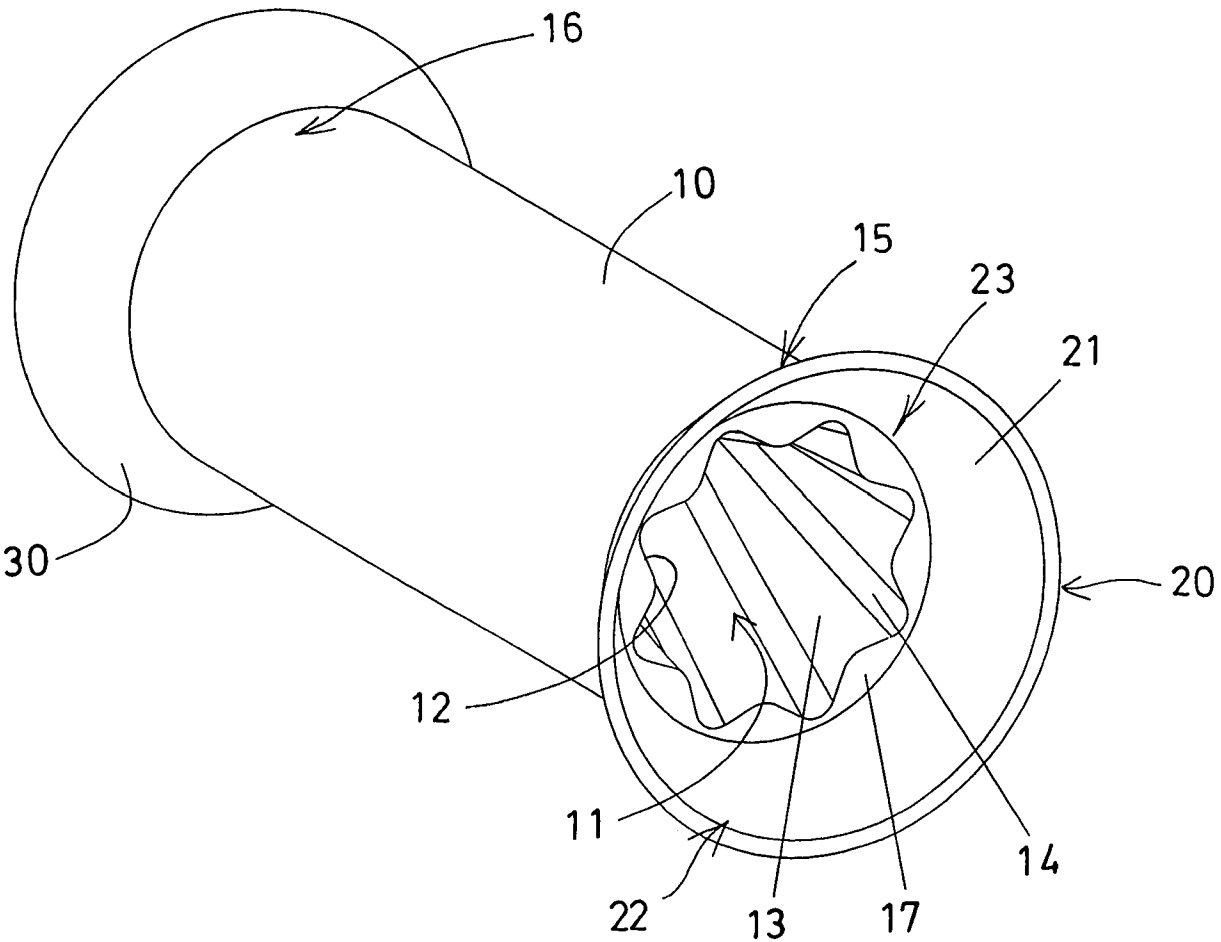
FIG. 1 is a perspective view of an intake tubing for engines in accordance with the present invention.
Figure 2:
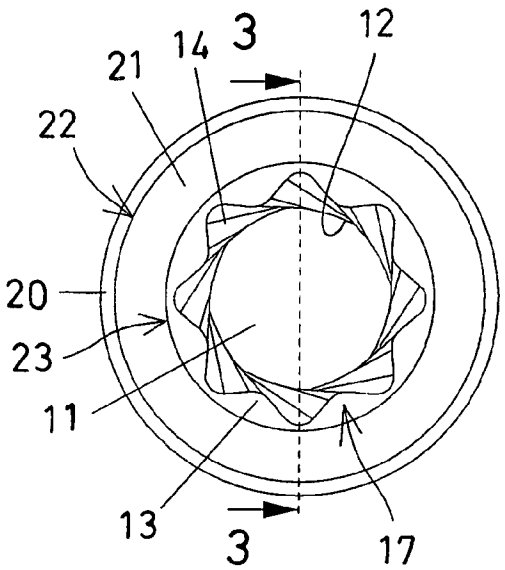
FIG. 2 is an end view of the intake tubing for engines.
Figure 3:
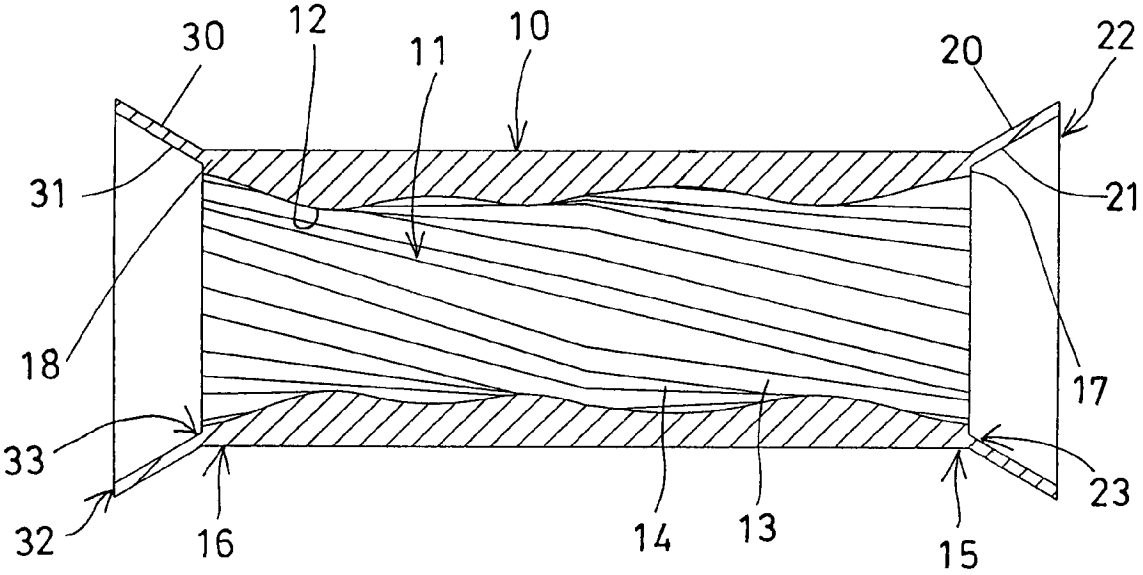
FIG. 3 is a cross sectional view of the intake tubing for engines, taken along lines 3—3 of FIG. 2.

Referring to the drawings, and initially to FIGS. 1–3, an intake tubing for engines in accordance with the present invention comprises a tubular member 10 including a chamber 11 formed or provided therein and defined by an inner peripheral surface 12, and including a number of helical protuberances 13 and a number of helical grooves 14 extended or formed therein, and preferably equally spaced away from each other.

The tubular member 10 includes two ends or an inlet end 15 and an outlet end 16 each having a cone member of flared member 20, 30 provided thereon or extended therefrom. The flared member 20 may be coupled to a gas or fuel or fluid supplier (not shown) to receive the gas and/or the injecting fuel or the fluid 40 therefrom, and the other flared member 30 may be coupled to an engine (not shown) for supplying the gas and/or the injecting fuel or the fluid 40 to the engine. Each of the flared members 20, 30 includes an inner peripheral surface 21, 31, and each tapers conically from an outer opening 22, 32 with a greater diameter to an inner opening 23, 33 with a smaller diameter.

It is preferable that the inner diameter of the inner openings 23, 33 of the flared members 20, 30 is greater than that of the ends 15, 16 of the tubular member 10, to form a peripheral shoulder 17, 18 between the tubular member 10 and the flared members 20, 30 respectively. The flared members 20, 30 are provided for allowing gas and/or injecting fuel or fluid 40 to suitably flow into the tubular member 10, best shown in FIGS. 4, 5.

Figure 4:
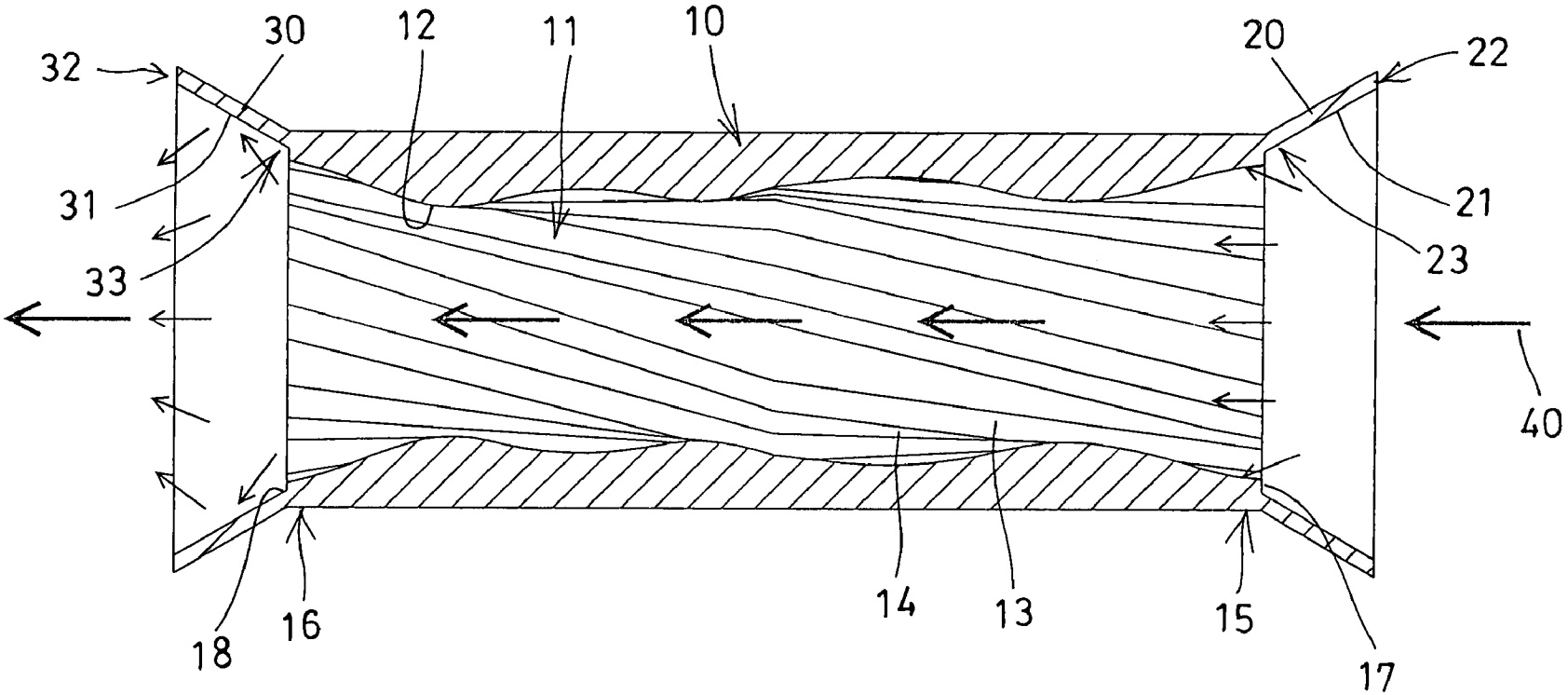
FIGS. 4, 5 are cross sectional views similar to FIG. 3, illustrating the operation of the intake tubing for engines.

In operation, as shown in FIG. 4, when the gas and/or the injecting fuel or the fluid 40 is supplied or flows in high speed into the flared member 20 and the inlet end 15 of the tubular member 10, the fluid 40 may be guided to flow through the chamber 11 of the tubular member 10 in high speed by the helical grooves 14 of the tubular member 10, to allow the gas and/or the injecting fuel or the fluid 40 to be supplied into the engines in high speed and in great flowing quantity, such that the operating efficiency or the power of the engine may be increased.

Figure 5:
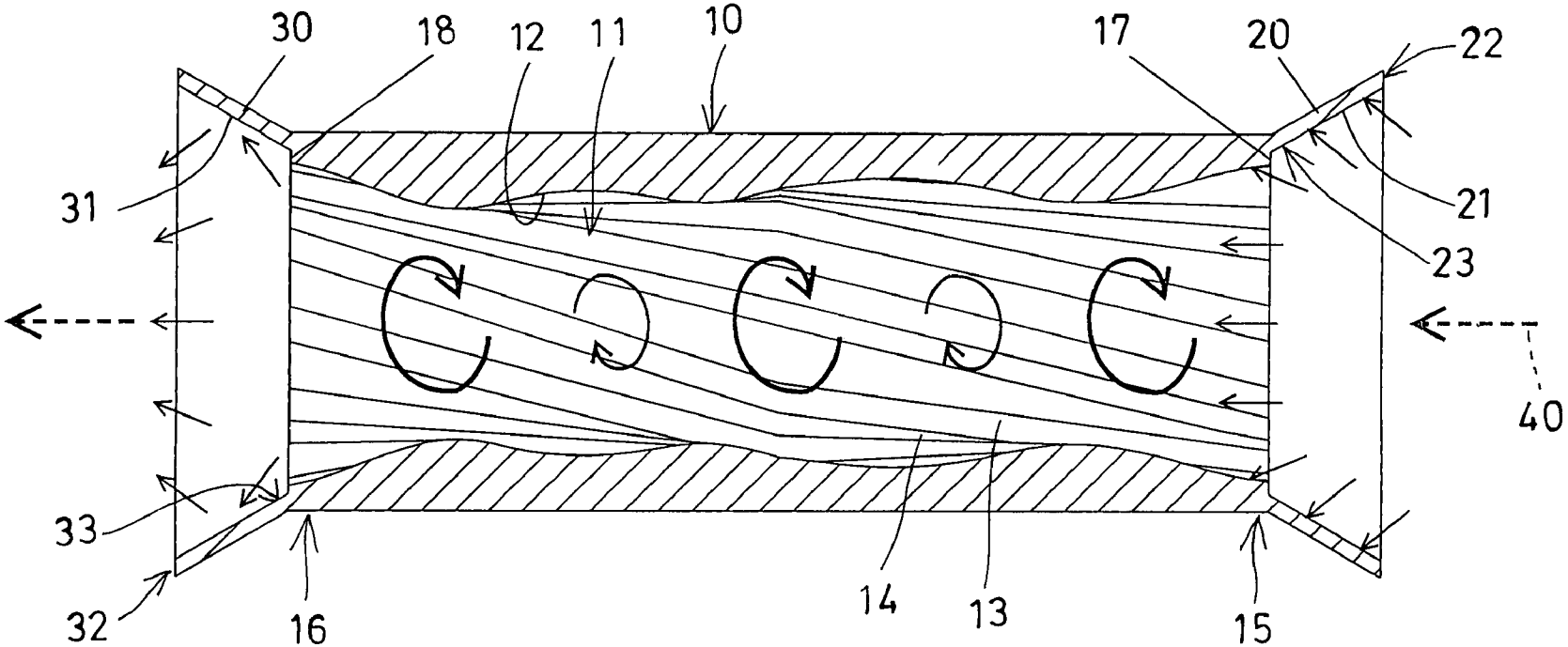

On the contrary, as shown in FIG. 5, when the gas and/or the injecting fuel or the fluid 40 is supplied or flows in low speed into the flared member 20 and the inlet end 15 of the tubular member 10, the fluid 40 may be guided to generate eddy currents 41 within the chamber 11 of the tubular member 10, and the eddy currents 41 may block or lower the flowing speed and the flowing quantity of the gas and/or the injecting fuel or the fluid 40 into the engines, such that the fuel or fluid 40 may be economized.

The flowing quantity of the gas and/or the injecting fuel or the fluid 40 may thus be adjusted or regulated automatically by the flowing or supplying speed of the gas and/or the injecting fuel or the fluid 40 toward the tubular member 10 and the engine.

Accordingly, the intake tubing in accordance with the present invention may be used or provided for suitably adjusting or regulating the flowing speed and/or the flowing quantity of pressurized fuel oil and/or gas into or through the engine cylinders of the engines.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An intake tubing for an engine comprising:

a tubular member including a chamber formed therein and defined by an inner peripheral surface, and including a plurality of helical protuberances and a plurality of helical grooves formed therein, said tubular member including an inlet end for receiving fluid, and an outlet end for coupling to the engine, and including a first flared member extended from said inlet end thereof, and said first flared member including an inner peripheral surface tapered conically from an outer opening with a greater diameter to an inner opening with a smaller diameter, said inner opening of said first flared member including an inner diameter greater than that of said inlet end of said tubular member, to form a peripheral shoulder between said tubular member and said first flared member, and said helical protuberances and said helical grooves of said tubular member being provided to guide the fluid to flow through said chamber of said tubular member in great speed when the fluid is supplied in great speed toward said inlet end of said tubular member, and to generate eddy current and to lower the fluid to flow through said chamber of said tubular member when the fluid is supplied in low speed toward said inlet end of said tubular member.

2. The intake tubing as claimed in claim 1, wherein said tubular member includes a second flared member extended from said outlet end thereof, and said second flared member includes an inner peripheral surface, and tapers conically from an outer opening with a greater diameter to an inner opening with a smaller diameter.

3. The intake tubing as claimed in claim 2, wherein said inner opening of said second flared member includes an inner diameter greater than that of said outlet end of said tubular member, to form a peripheral shoulder between said tubular member and said second flared member.

* * * * *